US008511780B2

(12) United States Patent
Akiyama et al.

(10) Patent No.: US 8,511,780 B2
(45) Date of Patent: Aug. 20, 2013

(54) IMAGE FORMING APPARATUS

(75) Inventors: Shigeki Akiyama, Ichinomiya (JP); Kenichi Iesaki, Ichinomiya (JP); Kohei Terada, Nagoya (JP); Mitsuhiro Nozaki, Nagoya (JP); Tomoaki Hazeyama, Yokkaichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1169 days.

(21) Appl. No.: 12/130,407

(22) Filed: May 30, 2008

(65) Prior Publication Data

US 2008/0298827 A1 Dec. 4, 2008

(30) Foreign Application Priority Data

May 31, 2007 (JP) ..... 2007-145523

(51) Int. Cl.
*B41J 29/38* (2006.01)

(52) U.S. Cl.
USPC ..... 347/16

(58) Field of Classification Search
USPC ..... 347/16, 19, 104
See application file for complete search history.

(56) References Cited

U.S. PATENT DOCUMENTS

| | | | | | |
|---|---|---|---|---|---|
| 4,705,412 | A | * | 11/1987 | Matsumoto | 400/54 |
| 5,617,122 | A | * | 4/1997 | Numata et al. | 347/14 |
| 5,838,591 | A | * | 11/1998 | Yamaguchi | 700/299 |
| 2003/0142346 | A1 | * | 7/2003 | Shirotori et al. | 358/1.15 |
| 2005/0232674 | A1 | * | 10/2005 | Kakegawa | 400/319 |
| 2005/0240293 | A1 | * | 10/2005 | Kakegawa | 700/63 |
| 2006/0033461 | A1 | * | 2/2006 | Kakegawa et al. | 318/434 |

FOREIGN PATENT DOCUMENTS

| | | | | |
|---|---|---|---|---|
| JP | H05-254207 | A | | 10/1993 |
| JP | H11-038704 | A | | 2/1999 |
| JP | 2002-186285 | | * | 6/2002 |
| JP | 2002-271566 | A | | 9/2002 |
| JP | 2003-122071 | A | | 4/2003 |
| JP | 2006-123421 | A | | 5/2006 |
| JP | 2006-246670 | A | | 9/2006 |
| JP | 2007-062250 | A | | 3/2007 |
| JP | 2008-49638 | | * | 3/2008 |

OTHER PUBLICATIONS

Japan Patent Office; Notification of Reasons of Refusal in Japanese Patent Application No. 2007-145523 (counterpart to the above-captioned U.S. patent application) mailed May 26, 2009.

* cited by examiner

*Primary Examiner* — Julian Huffman
(74) *Attorney, Agent, or Firm* — Baker Botts L.L.P.

(57) ABSTRACT

An image forming apparatus comprises: an image forming mechanism including a motor, and an image forming unit which operates by the motor to form an image on a recording sheet; a registration unit which registers a job; a control unit which controls the image forming mechanism to form an image corresponding to the job registered through the registration unit on a recording sheet; a number obtaining unit which obtains the number of recording sheets required for the job registered through the registration unit; and a setting unit which sets a rotation speed of the motor according to the number of recording sheets obtained by the number obtaining unit. The control unit controls the image forming mechanism to form the image corresponding to the job registered through the registration unit on the recording sheet by rotating the motor at the rotation speed set by the setting unit.

9 Claims, 10 Drawing Sheets

(FIG. 4 CONTINUED)
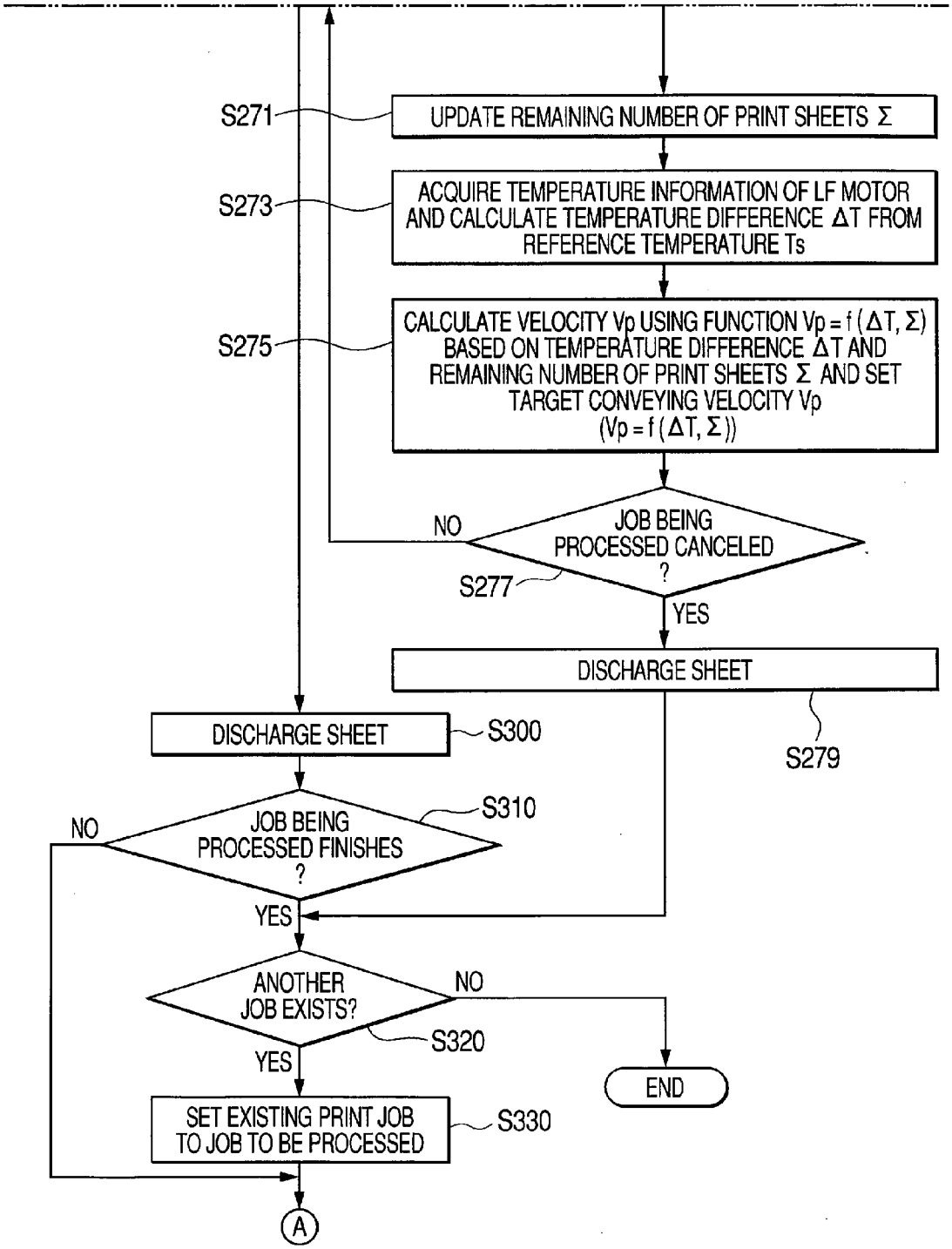

IMAGE FORMING APPARATUS

CROSS-REFERENCE TO RELATED APPLICATION

This application claims priority from Japanese Patent Application No. 2007-145523, filed on May 31, 2007, the entire subject matter of which is incorporated herein by reference.

TECHNICAL FIELD

Aspects of the present invention relate to an image forming apparatus which operates with a motor as a drive source and forms an image on a recording sheet.

BACKGROUND

An image forming apparatus includes: a sheet conveying mechanism which picks up recording sheets placed on a tray one by one from the tray, pinches the picked up recording sheet by rollers, conveys the recording sheet downstream of a conveyance passage by rotating the roller; and an image forming unit which forms an image on the recording sheet conveyed by operation of the sheet conveying mechanism at a record position downstream of the conveyance passage.

An image forming apparatus includes a carriage which is provided at a recording position and mounts thereon a recording head. By moving the carriage in a main scanning direction by one time, an image of a predetermined width in a sub-scanning direction along the sheet conveyance direction is formed on a recording sheet. This image forming apparatus forms an image by repeating an operation of conveying the recording sheet by the predetermined width and moving the carriage in the main scanning direction.

Usually, a motor is used as the drive source of the sheet conveying mechanism or the carriage conveying mechanism. For example, in the sheet conveying mechanism, the roller rotates while receiving the rotation force of the motor, thereby conveying a recording sheet. In the carriage conveying mechanism, the carriage moves in the main scanning direction along a guide shaft by the drive force of the motor.

By the way, in such kind of conveying mechanism using the motor, if the motor continues to operate for a long time, the motor becomes a high temperature due to heat generated by the motor. This may cause malfunction, a failure, and degradation of durability of the motor. In order to circumvent this problem, for example, in a related-art apparatus, if a motor becomes a high temperature exceeding an allowable temperature, the motor is stopped, etc., for suppressing the operating rate of the motor.

For example, JP-A-2006-246670 describes a related-art printer apparatus which detects the motor temperature, calculates the stop time of the motor from the detected motor temperature, and stops the motor for the calculated stop time.

However, in the related-art printer apparatus described in JP-A-2006-246670, if the motor becomes a high temperature, the motor stops automatically. Thus, if printing operations continue successively, the user can not use the printer and the user may be discontented with the situation. That is, even if only few pages to be printed remain, the related-art printer apparatus makes a transition to the stop state for the reason that the motor is at a high temperature. Thus, the user has to wait for output of the print result for few remaining pages and this is inconvenient for the user.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an image forming apparatus capable of adjusting drive of a motor to suppress the motor becoming a high temperature exceeding the allowable range more than ever before even if the apparatus is used for a long time.

According to an exemplary embodiment of the present invention, there is provide an image forming apparatus comprising: an image forming mechanism including a motor, and an image forming unit which operates by a driving force of the motor to form an image on a recording sheet; a registration unit which registers a job based on an external command; a control unit which controls the image forming mechanism to form an image corresponding to the job registered through the registration unit on a recording sheet; a number obtaining unit which obtains the number of recording sheets required for the job registered through the registration unit; and a setting unit which sets a rotation speed of the motor according to the number of recording sheets obtained by the number obtaining unit, wherein the control unit controls the image forming mechanism to form the image corresponding to the job registered through the registration unit on the recording sheet by rotating the motor at the rotation speed set by the setting unit.

According to another exemplary embodiment of the present invention, there is provided an image forming apparatus comprising: an image forming mechanism including a motor, and an image forming unit which operates by a driving force of the motor to form an image on a recording sheet; a registration unit which registers a job based on an external command; a control unit which controls the image forming mechanism to form an image corresponding to the job registered through the registration unit on a recording sheet; a temperature acquisition unit which acquires temperature information indicating a temperature of the motor; and a setting unit which sets a rotation speed of the motor according to the temperature of the motor indicated by the temperature information acquired by the temperature acquisition unit, wherein the control unit controls the image forming mechanism to form the image corresponding to the job registered through the registration unit on the recording sheet by rotating the motor at the rotation speed set by the setting unit.

According to a further exemplary embodiment of the present invention, there is provided an image forming apparatus comprising: a motor; an image forming unit which operates by a drive force of the motor to form an image on a recording sheet; a registration unit which registers a job based on an external command; and a motor control unit which controls a rotation speed of the motor; wherein, while the image forming unit forms an image corresponding to the job registered through the registration unit, if an additional job is registered through the registration unit, the motor control unit changes a rotation speed of the motor.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Exemplary embodiments of the present invention will be described with reference to the accompanying drawings.

First Exemplary Embodiment

Figure 1:
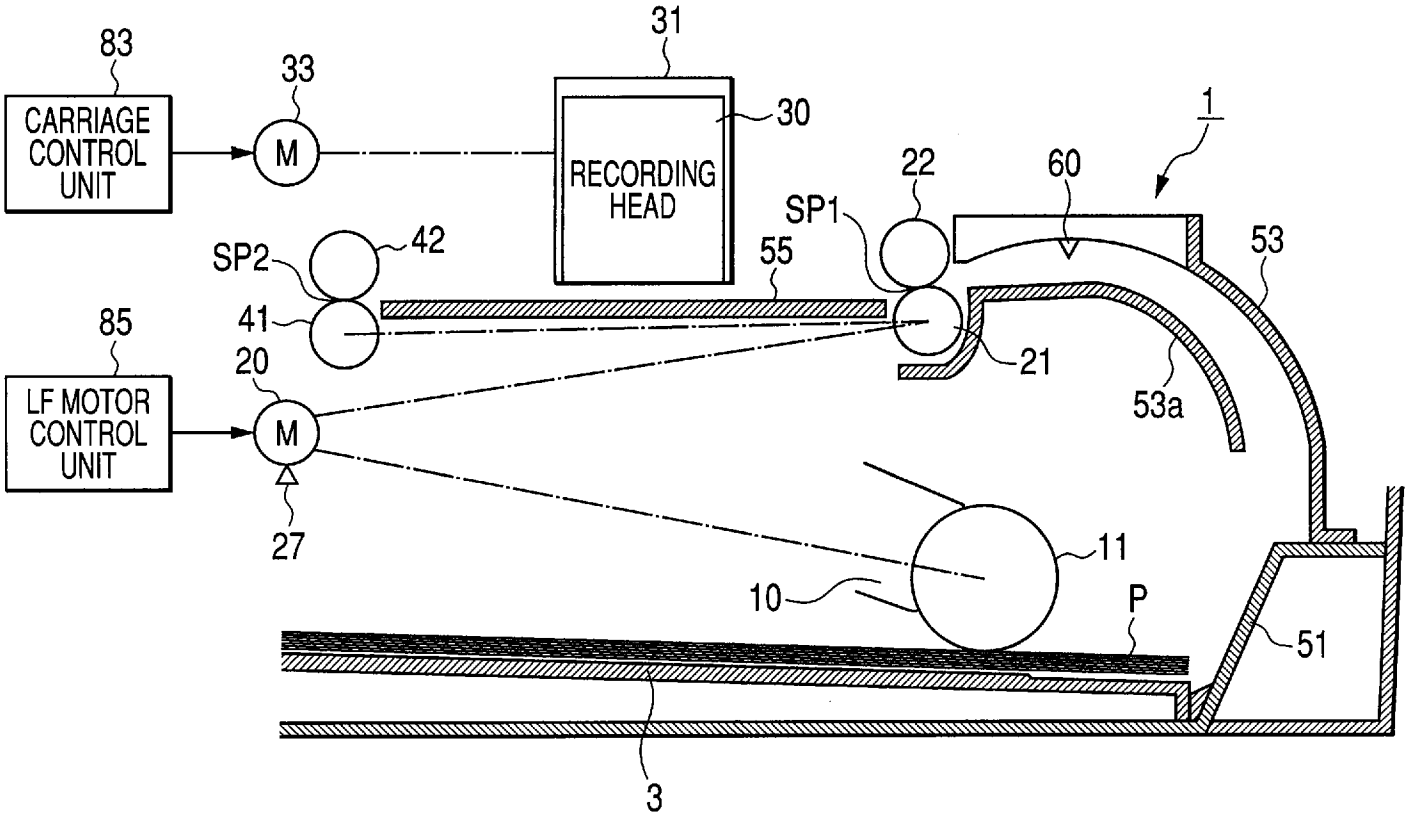
FIG. 1 is a sectional view to show the configuration of an ink-jet printer according to a first exemplary embodiment of the present invention.
Figure 2:
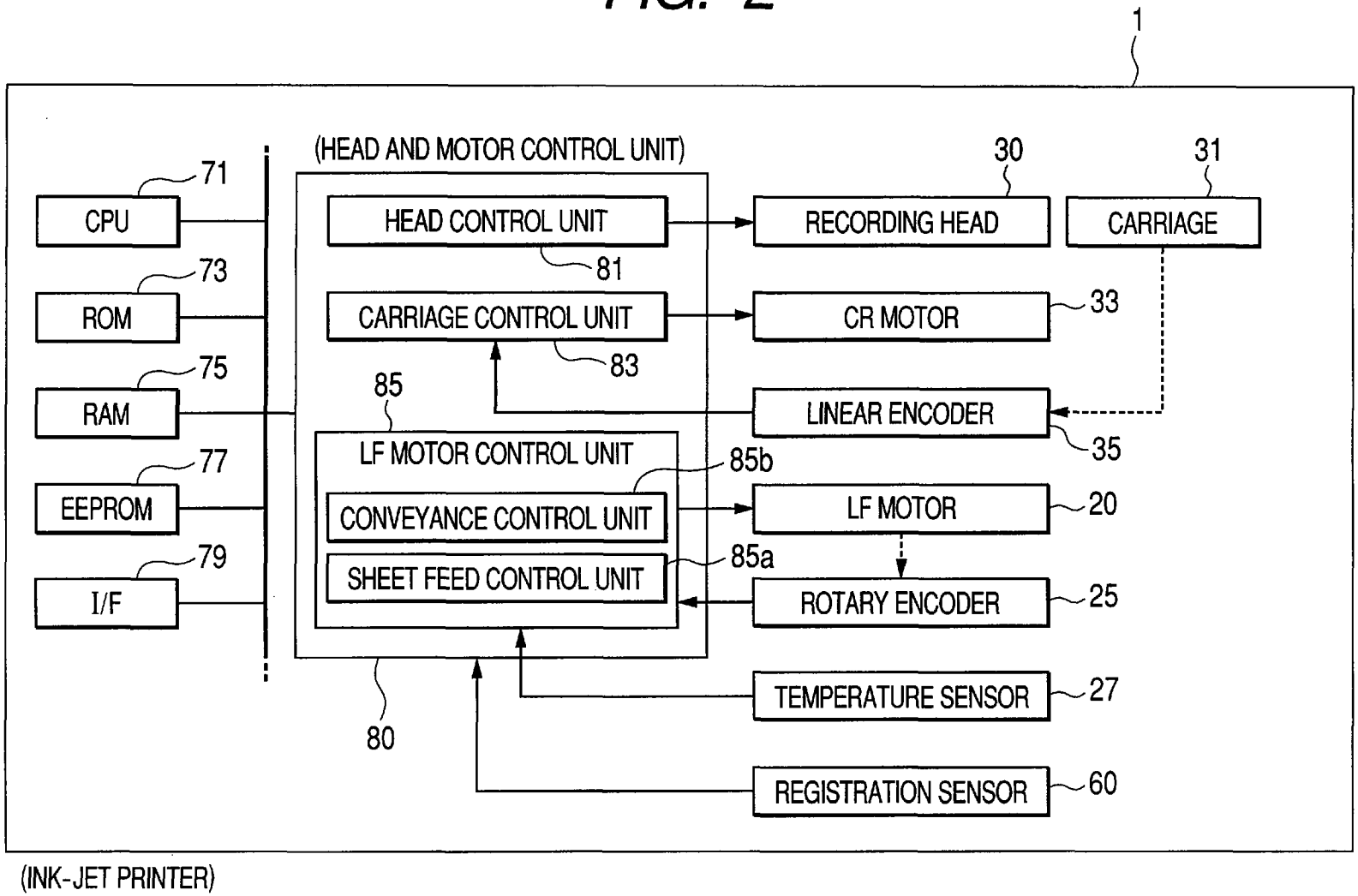
FIG. 2 is a block diagram to show the electric configuration of the ink-jet printer according to the first exemplary embodiment.

FIG. 1 is a sectional view to show the configuration of an ink-jet printer 1 according to a first exemplary embodiment of the present invention, and FIG. 2 is a block diagram to show the electric configuration of the ink-jet printer 1.

As shown in FIG. 1, the ink-jet printer 1 according to the first exemplary embodiment includes: a sheet feed tray 3 on which a plurality of sheet P are stacked; a sheet feed unit 10 which separates the sheets P stacked in the sheet feed tray 3 and delivers the sheet to a conveyance passage one by one, a conveying roller 21 which pinches the sheet P delivered to the conveyance passage by rotation of a sheet feed roller 11 included in the sheet feed unit 10 together with a pinch roller 22 opposed to the conveying roller 21 and conveys the sheet P to a record position below a recording head 30 by rotation operation; a discharge roller 41 which pinches the sheet P conveyed from the conveying roller 21 together with a pinch roller 42 opposed to the discharge roller 41 and discharges the sheet P to a sheet discharging tray (not shown) positioned downstream of the conveyance passage by rotation operation; and a bank part 51, a U turn path 53, and a platen 55 which configure the conveyance passage of the sheet P.

The sheet feed unit 10 receives a drive force of an LF motor 20 implemented as a DC motor and rotates the sheet feed roller 11; the sheet feed roller 11 abuts against the top face of the sheet P placed on the sheet feed tray 3 and the topmost sheet P placed on the sheet feed tray 3 is separated by rotation of the sheet feed roller 11 and is delivered to the conveyance passage.

The upstream part of the conveyance passage constituted by the bank part 51 and the U turn path 53 is provided for regulating a move of the sheet P delivered by the sheet feed roller 11 and guiding the sheet P to a contact SP1 between the conveying roller 21 and the pinch roller 22 positioned downstream of the conveyance passage. An auxiliary part 53*a* for regulating a downward move of the sheet P and guiding the sheet P into the contact SP1 between the conveying roller 21 and the pinch roller 22 is provided below the downstream part of the U turn path 53.

In the ink-jet printer 1 according to the first exemplary embodiment, the sheet P delivered from the sheet feed tray 3 through the sheet feed roller 11 is guided by the thus configured conveyance passage thus to the contact SP1 between the conveying roller 21 and the pinch roller 22 positioned downstream of the U turn path 53 and the auxiliary part 53*a*.

A registration sensor 60 is provided upstream from the contact SP1. The registration sensor 60 detects the leading end position and the trailing end position of the sheet P in the ink-jet printer 1.

The sheet P guided into the contact SP1 is pulled into between the conveying roller 21 and the pinch roller 22 by the rotation operation of the conveying roller 21 and is sandwiched between the conveying roller 21 and the pinch roller 22. Then, the sheet P is conveyed downstream of the conveyance passage at the distance corresponding to the rotation amount of the conveying roller 21 with rotation of the conveying roller 21.

The platen 55 forms the downstream part of the conveyance passage, which connects the conveying roller 21 and the discharge roller 41. The platen 55 guides the sheet P conveyed from the conveying roller 21 into the record position at which an image is to be formed by the recording head 30 and also guides the sheet P with an image formed thereon by the recording head 30 into a contact SP2 between the discharge roller 41 and the pinch roller 42.

The sheet P is conveyed along the platen 55 to the discharge roller 41 and when the leading end of the sheet P reaches the contact SP2 between the discharge roller 41 and the pinch roller 42, the sheet P is pulled into between the discharge roller 41 and the pinch roller 42 with rotation of the discharge roller 41 and is sandwiched between the discharge roller 41 and the pinch roller 42. Then, the sheet P is discharged to the sheet discharging tray with rotation of the discharge roller 41.

The discharge roller 41 and the conveying roller 21 have the same diameter and are driven and rotated by the LF motor 20 same as the sheet feed roller 11. That is, in the ink-jet printer 1 according to the first exemplary embodiment, the conveying roller 21 and the discharge roller 41 are joined by a belt and the conveying roller 21 receives the drive force of the LF motor 20 and the discharge roller 41 rotates in conjunction with the conveying roller 21.

While the sheet feed roller 11 is driven, the conveying roller 21 is placed in a non-connection state to the LF motor 20, that is, a state in which the drive force of the LF motor 20 is not transmitted to the conveying roller 21. In other words, in the ink-jet printer 1, when the sheet feed operation starts, the sheet feed roller 11 and the LF motor 20 are connected and the conveying roller 21 and the LF motor 20 are placed in the non-connection state and only the sheet feed roller 11 rotates upon reception of the drive force of the LF motor 20. When the sheet feed operation finishes, the sheet feed roller 11 and the LF motor 20 are placed in a non-connection state and the conveying roller 21 and the LF motor 20 are connected.

In addition, the recording head 30 includes a plurality of nozzles which are arranged on a bottom face opposed to the platen 55 and eject ink droplets. The recording head 30 is mounted on a carriage 31 that moves in a main scanning direction (direction perpendicular to the plane of FIG. 1) along a guide shaft (not shown), and the carriage 31 is driven by a CR (carriage) motor 33 implemented as a DC motor and moves in the main scanning direction.

Subsequently, the electric configuration of the ink-jet printer 1 will be described. As shown in FIG. 2, the ink-jet printer 1 according to the first exemplary embodiment includes: a central processing unit (CPU) 71; a read only memory (ROM) 73 storing programs, etc., executed by the CPU 71; a random access memory (RAM) 75 used as a work area at the program execution time, an electrically erasable and programmable read-only memory (EEPROM) 77 storing various pieces of setting information, an interface 79 connected to a personal computer (not shown) for receiving a print command transmitted from the personal computer and print data transmitted together with the print command, and a head and motor control unit 80.

The ink-jet printer 1 further includes: the recording head 30; the carriage 31; the CR motor 33 for driving the carriage 31 to move in the main scanning direction; a linear encoder 35 which is provided along the guide axis and generates a pulse signal in response to the position of the carriage 31. The head and motor control unit 80 includes a carriage control unit 83 which controls the CR motor 33 to move the carriage 31 in the main scanning direction and a head control unit 81 which controls the recording head 30 to eject ink droplets therefrom, thereby forming an image in the main scanning direction.

The linear encoder 35 is connected to the head and motor control unit 80 and an output signal of the linear encoder 35 is input to the head and motor control unit 80. The output signal of the linear encoder 35 is used for controlling the CR motor 33 by the carriage control unit 83.

The ink-jet printer 1 also includes the LF motor 20 and a rotary encoder 25 for outputting a pulse signal each time the LF motor 20 rotates a predetermined amount. The rotary encoder 25 is connected to the head and motor control unit 80 and an output signal of the rotary encoder 25 is input to the head and motor control unit 80.

That is, the ink-jet printer 1 detects the rotation amount of the LF motor 20 and further the conveyance amount of the sheet P based on the output signal of the rotary encoder 25. The head and control unit 80 further includes an LF motor control unit 85 which controls the LF motor 20 based on the detection result to perform the sheet feed operation from the sheet feed tray 3 to the conveying roller 21 and the sheet conveying operation until discharging the taken-in sheet P by the conveying roller 21.

Specifically, the LF motor control unit 85 includes a sheet feed control unit 85*a* which controls rotation of the sheet feed roller 11 to perform the sheet feed operation from the sheet feed tray 3 to the conveying roller 21, and a conveyance control unit 85*b* which controls rotation of the conveying roller 21 to perform the sheet conveying operation until discharging the taken-in sheet P by the conveying roller 21.

In addition, a temperature sensor 27 is attached to the surface of the LF motor 20 for detecting temperature of the LF motor 20. The temperature sensor 27 is connected to the head and motor control unit 80, and information of the temperature detected by the temperature sensor 27 is input to the head and motor control unit 80. The temperature information input to the head and motor control unit 80 is provided for the CPU 71.

The registration sensor 60 is connected to the head and motor control unit 80. The head and motor control unit 80 detects the sheet position in the conveyance passage according to an output signal of the registration sensor 60 and an output signal of the rotary encoder 25. The detected position information of the sheet P is provided for the CPU 71. Upon reception of a command from the CPU 71, the head and motor control unit 80 controls the recording head 30, the CR motor 33, and the LF motor 20 in accordance with the command.

Figure 3:
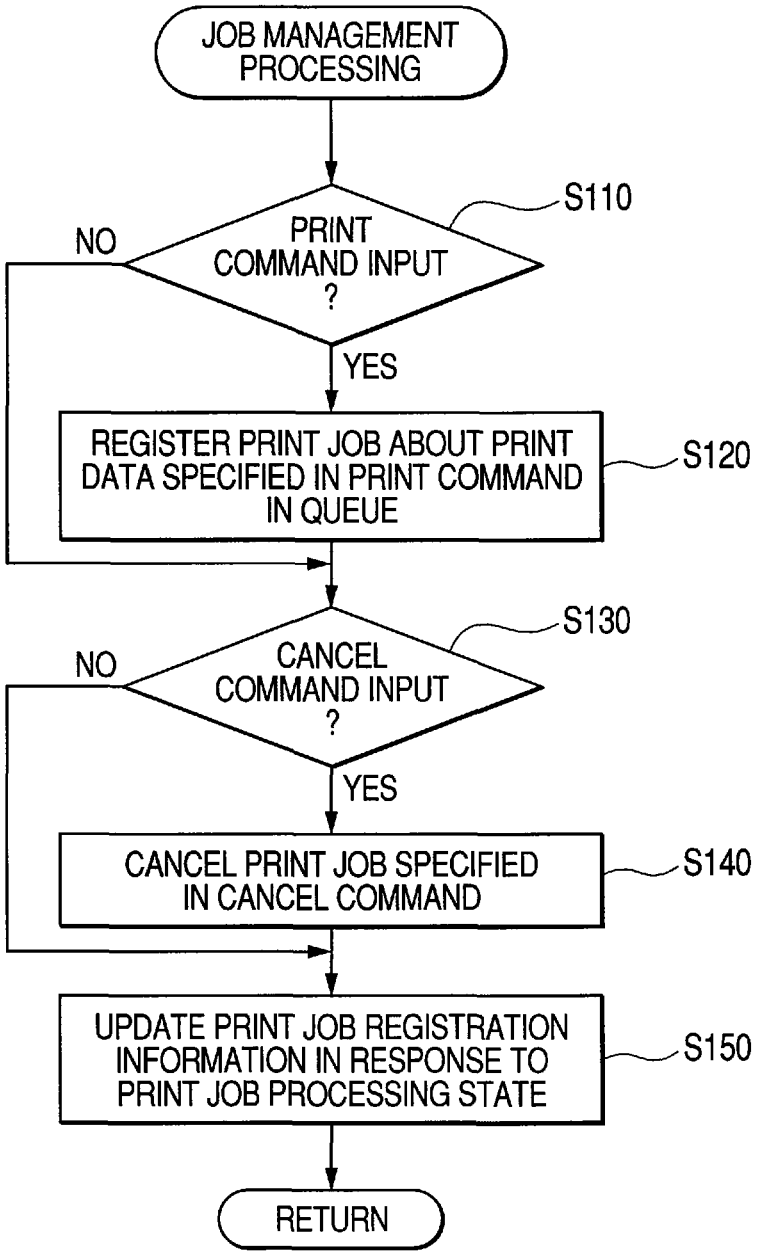
FIG. 3 is a flowchart to show job management processing according to the first exemplary embodiment.
Figure 4:
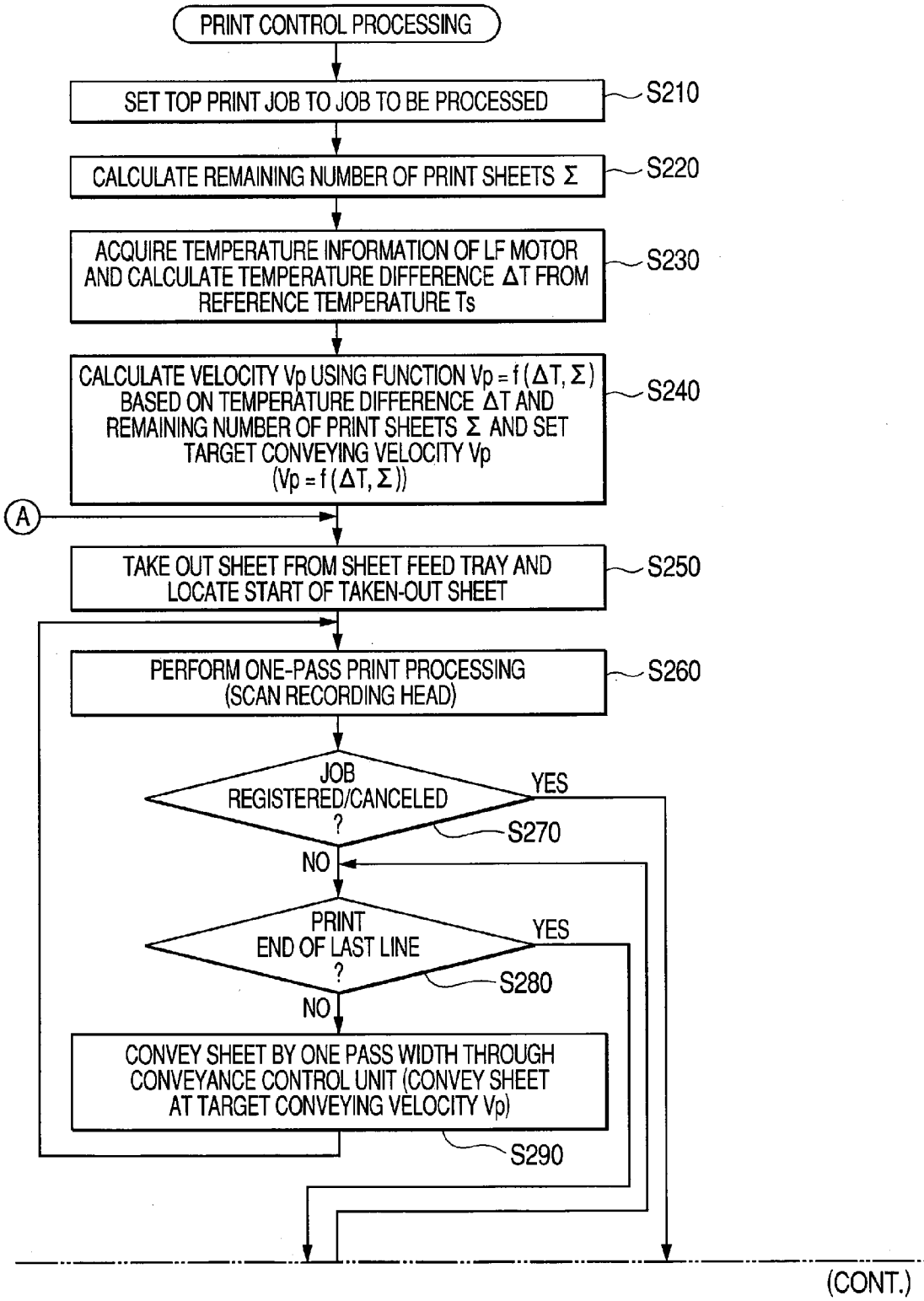
FIG. 4 is a flowchart to show print control processing according to the first exemplary embodiment.

The ink-jet printer 1 executes job management processing shown in FIG. 3 in the CPU 71, thereby registering a print job about print data specified in a print command based on the print command input from the personal computer and executes print control processing shown in FIG. 4, thereby processing the registered print job and forms (prints) an image based on the print data input from the personal computer on the sheet P by controlling the recording head 30, the CR motor 33, and the LF motor 20 through the head and motor control unit 80.

The job management processing and the print control processing executed by the CPU 71 will be discussed. FIG. 3 is a flowchart to show the job management processing repeatedly executed by the CPU 71 during the ink-jet printer 1 is ON.

Upon starting the job management processing shown in FIG. 3, the CPU 71 determines whether or not a print command is input from the external personal computer through the interface 79 (S110). If it is determined that a print command is input (YES at S110), a print job about the print data specified in the print command is registered in a queue (S120). Then the processing proceeds to S130. On the other hand, if it is determined that a print command is not input (NO at S110), the processing proceeds to S130 without executing S120.

At S130, the CPU 71 determines whether or not a cancel command about the print job is input from the external personal computer (S130). If it is determined that a cancel command is input (YES at S130), the print job specified in the cancel command is deleted from the queue (S140). Then, the processing proceeds to S150. On the other hand, if it is determined that a cancel command is not input (NO at S130), the processing proceeds to S150 without executing S140.

At S150, the CPU 71 updates print job registration information in response to a print job processing state. That is, the finished print job is deleted from the queue and updates the print job registration information. Then, the job management processing ends at the moment.

FIG. 4 is a flowchart to show the print control processing executed by the CPU 71. The CPU 71 starts the print control processing if a new print job is registered in a state in which no print job exists.

Upon starting the print control processing, then the CPU 71 sets the top print job registered in the queue (the earliest registered print job of the print jobs registered in the queue) to a job to be processed (S210). Then, the CPU 71 calculates the number of sheets required for processing all of the job to be processed and the print jobs registered in the queue. That is, the remaining number of print sheets Σ is calculated (S220).

For example, if the print data corresponding to the job to be processed is 10-sheet data and only the job to be processed is registered in the queue as a print job, the remaining number of print sheets Σ is calculated as 10. If the print data corresponding to the job to be processed is 10-sheet data and a print job requiring 10 sheets is registered in the queue as print jobs other than the job to be processed, the remaining number of print sheets Σ is calculated as 20.

After the CPU 71 calculates the remaining number of sheets Σ (S220) as described above, the processing proceeds to S230 and acquires temperature information indicating the temperature of the LF motor 20 detected by the temperature sensor 27 through the head and motor control unit 80 from the temperature sensor 27. The temperature difference between the current temperature Tn of the LF motor 20 and a reference temperature Ts (herein referred to as $\Delta T = Ts - Tn$) is calculated based on the acquired temperature information. In the first exemplary embodiment, it is assumed that based on upper limit Tp of the allowable temperature of the LF motor 20, the reference temperature Ts is defined as a temperature lower than the upper limit Tp by a minute amount.

After the temperature difference ΔT is calculated, the CPU 71 calculates and sets target conveying velocity Vp in performing the sheet conveying operation with using a function Vp=f (ΔT, Σ) based on the temperature difference ΔT and the remaining number of print sheets Σ calculated as described above. The function Vp=f (ΔT, Σ) is a function of the temperature difference ΔT and the remaining number of print sheets Σ and is experimentally found in advance.

In the first exemplary embodiment, the function f (ΔT, Σ), in which the temperature difference ΔT and the remaining number of print sheets Σ are variable, is determined as follows at the design time. Specifically, in the first exemplary embodiment, an experiment is performed in which under the conditions where the temperature difference between the reference temperature Ts and the current motor temperature Tn is ΔT and the remaining number of print sheets is Σ, the image formation operation on as many sheets as the remaining number of print sheets E is executed with using the LF motor 20 to convey the sheets. Then, a function capable of calculating the target conveying velocity Vp at which the final temperature of the LF motor 20 becomes the reference temperature Ts at the time of finishing the image formation operation on as many sheets as the remaining number of print sheets Σ (at the time of discharging the Σ-th sheet) is determined as the function Vp=f (ΔT, Σ) (see FIG. 7A). This function Vp=f (ΔT, Σ) is previously converted into a program code and at S240, the target conveying velocity Vp satisfying the above-described condition is calculated.

If the function Vp=f (ΔT, Σ) is determined according to the above-described procedure, the target conveying velocity Vp is set as follows at S240. As the value ΔT/Σ resulting from dividing the temperature difference ΔT by the remaining number of print sheets Σ is lower, the target conveying velocity Vp is set to a lower value; as the value ΔT/Σ is larger, the target conveying velocity Vp is set to a higher value. That is, the target conveying velocity Vp is determined by a monotone increasing function of the parameter ΔT/Σ.

Figure 5:
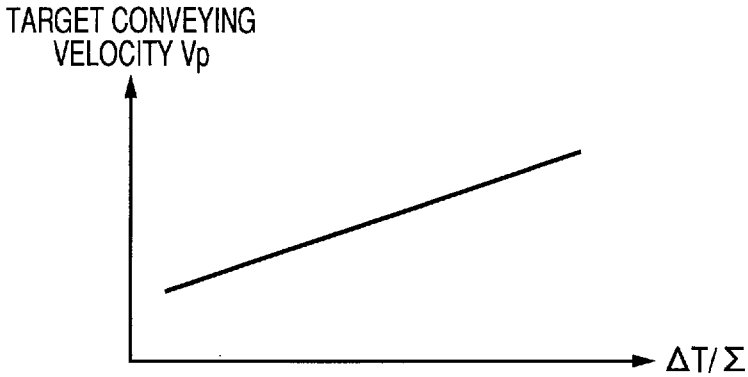
FIG. 5 is a graph to schematically show the relationship between a value and target conveying velocity.

FIG. 5 is a graph to schematically show the relationship between ΔT/Σ and the target conveying velocity Vp. Although FIG. 5 shows the relationship between ΔT/Σ and the target conveying velocity Vp as a linear function, the relationship between ΔT/Σ and the target conveying velocity Vp is found experimentally and is not necessarily determined as a linear function.

After setting the target conveying velocity Vp at S240, the processing proceeds to S250. At S250, the CPU 71 starts the sheet feed control unit 85*a*, causes the sheet feed control unit 85*a* to drive the LF motor 20 so as to drive the sheet feed roller 11, and causes the sheet feed roller 11 to separate one of the sheets P placed on the sheet feed tray 3 and convey the leading end of the sheet P to the contact SP1 between the conveying roller 21 and the pinch roller 22. The ink-jet printer 1 thus performs the sheet feed operation.

When the sheet P is conveyed to the contact SP1, the CPU 71 starts the conveyance control unit 85*b*, causes the conveyance control unit 85*b* to drive the LF motor 20 so as to drive the conveying roller 21, and causes the conveying roller 21 to take the sheet P conveyed to the contact SP1 into the downstream part of the conveyance passage and convey the sheet P until the print start point in the sheet P reaches the record position. That is, at S250, the sheet feed and beginning location operation is performed.

It is assumed that the sheet conveying velocity in the sheet feed and beginning location operation is previously fixed irrespective of the temperature Tn of the LF motor 20 or the remaining number of print sheets Σ. That is, in the first exemplary embodiment, the sheet taken out from the tray is conveyed at a predetermined conveying velocity and the beginning of the sheet is located without considering the temperature Tn or the remaining number of print sheets Σ. However, at S250, the temperature Tn and the remaining number of print sheets Σ may be considered for setting the sheet conveying velocity and performing the sheet feed and beginning location operation of the sheet P.

Upon finishing of the beginning location operation of the sheet P in the above-described manner, the processing proceeds to S260. At S260, the CPU 71 executes print processing to form an image based on the print data corresponding to the job being processed in the area of the print sheet P at the record position through the recording head 30. That is, at S260, the CPU 71 inputs a command to the head and motor control unit 80, starts the carriage control unit 83, and causes the carriage control unit 83 to drive the CR motor 33 for moving the carriage 31 in the main scanning direction. At the same time, the CPU 71 drives the recording head 30 through the head control unit 81 and causes the recording head 30 to execute ejection operation of ink droplets corresponding to the image to be formed while moving the carriage 31. The CPU 71 thus forms (prints) the image corresponding to the job being processed in the area of the sheet P at the record position.

The recording head 30 includes a plurality of nozzles in the sub-scanning direction (conveying direction of the sheet P) perpendicular to the main scanning direction (line direction) and forms an image of a plurality of dots in the sub-scanning direction. Therefore, an image of a predetermined width is formed in the sub-scanning direction on the sheet P by one scanning of the recording head 30. Hereinafter, the predetermined width will be referred to as "one-pass width."

After the print processing for one path width finishes (S260), the processing proceeds to S270. At S270, the CPU 71 determines whether or not additional registration or cancel operation of a print job is performed in the job management processing (S270). If the CPU 71 determines that neither additional registration nor cancel operation of a print job is performed (NO at S270), the processing proceeds to S280.

At S280, the CPU 71 determines whether or not image print of the last line of the print sheet P being printed finishes. If it is determined that the image print of the last line finishes (YES at S280), the processing proceeds to S300. If it is determined that the image print of the last line does not finish (NO at S280), the processing proceeds to S290.

At S290, the CPU 71 starts the conveyance control unit 85*b*, causes the conveyance control unit 85*b* to drive the LF motor 20, and causes the conveying roller 21 and the discharge roller 41 to convey the sheet P pinched by the conveying roller 21 or the discharge roller 41 by a certain amount downstream of the conveyance passage. Thus, the sheet conveyance for one-pass width is performed.

Specifically, the conveyance control unit 85*b* to rotate the LF motor 20 at the velocity corresponding to the preset target conveying velocity Vp for conveying the sheet P by a one-pass width D downstream of the conveyance passage. In the first exemplary embodiment, the sheet P is firmly pinched by the conveying roller 21 or the discharge roller 41 and thus the sheet P is conveyed by the distance proportional to the rotation amount of the LF motor 20 at the velocity proportional to the rotation speed of the LF motor 20 by driving the LF motor 20 through the conveyance control unit 85*b*.

Figure 6A:
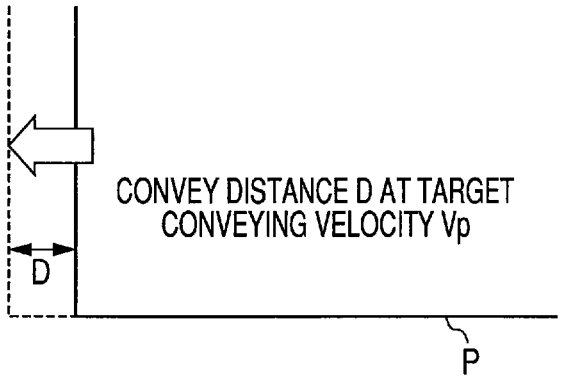
FIGS. 6A to 6C are schematic representations to show a conveying mode, a conveying velocity variation, and a position variation of a sheet according to the first exemplary embodiment.
Figure 6B:
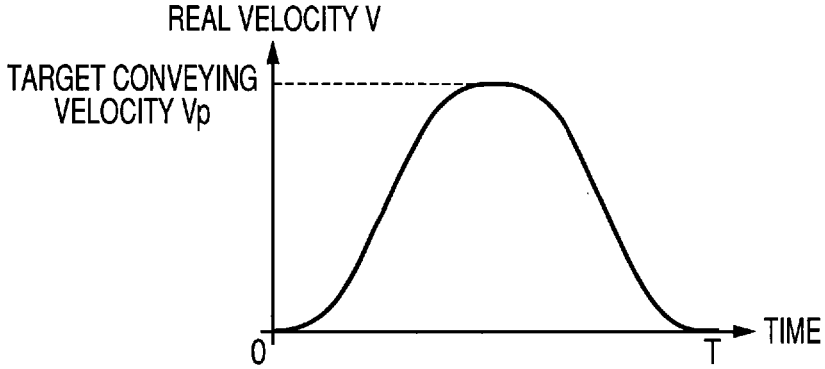

FIG. 6A is a schematic representation to show the conveying mode of the sheet P at S290; FIG. 6B is a graph to show a velocity variation of conveying velocity V realized when the conveyance control unit 85*b* drives the LF motor 20 at the target conveying velocity Vp; and FIG. 6C is a graph to show a position variation when the sheet P is conveyed by a predetermined amount (one-pass width) D.

Figure 6C:
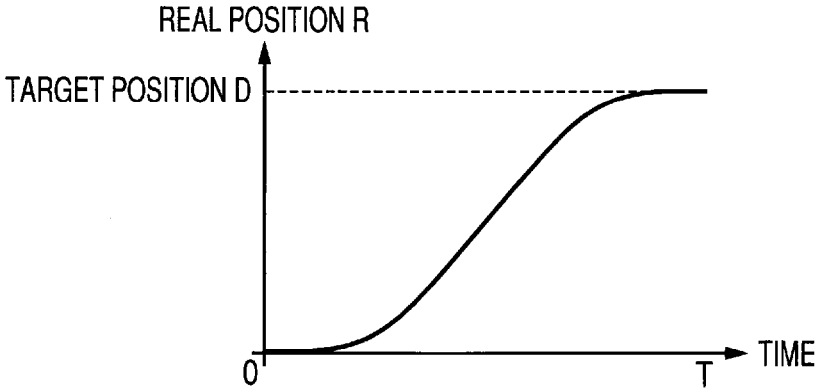

As shown in FIGS. 6B and 6C, in the first exemplary embodiment, to convey the sheet P at the target conveying velocity Vp, the sheet P is smoothly accelerated to the target conveying velocity Vp and then is smoothly decelerated so that the sheet P stops when the sheet P moves the distance D, and the sheet P is moved by the one-pass width D.

After finishing the sheet conveying operation for the one-pass width, the processing proceeds to S260 and print processing for one-path width is executed in a new area of the sheet P placed at the record position by delivering the sheet P. Then, the processing proceeds to S270. Thus, in the first exemplary embodiment, the sheet is delivered to the record position by a predetermined amount (one-pass width) at a time and whenever the sheet is delivered, the recording head 30 is scanned and an image based on the print data is formed in the area of the sheet P as much as the predetermined amount, thereby performing the image formation operation to form a series of images on the sheet P.

Upon finishing the image print of the last line (YES at S280), the processing proceeds to S300 and the CPU 71 causes the conveyance control unit 85*b* to drive the LF motor 20 for rotating the discharge roller 41 to discharge the post-printed sheet P.

Upon finishing of discharging the sheet P, the CPU 71 determines whether or not the job being processed finishes (S310). If it is determined that that the job being processed is not finished (NO at S310), the processing proceeds to S250. At S250, the CPU 71 conveys a new sheet from the sheet feed tray 3 and locates the beginning of the sheet and then repeats the print processing for one-pass width and sheet conveying operation alternately, thereby performing the image formation operation to form an image corresponding to the job being processed on the new sheet.

On the other hand, if it is determined that the job being processed finishes (YES at S310), the processing proceeds to S320. At S320, the CPU 71 determines whether or not an unprocessed print job is registered in the queue. If it is determined that an unprocessed print job is registered (YES at S320), the CPU 71 sets the top print job of unprocessed print jobs registered in the queue to a new job to be processed (S330), and the processing proceeds to S250.

At S250, a new sheet is conveyed from the sheet feed tray 3 to the beginning position and the print processing for one-pass width and sheet conveying operation are alternately repeated, thereby forming an image based on the print data corresponding to the print job set as the new job to be processed on the new sheet.

If it is not determined that an unprocessed print job is registered (NO at S320), the CPU 71 finishes the print control processing and when a new print job is registered, the CPU 71 again starts print control processing from S210.

If additional registration or cancel operation of the job is performed in the job management processing during execution of the print control processing, the processing proceeds to S271 (YES at S270) and calculates the remaining number of print sheets Σ upon considering the additional registration or the cancel operation.

For example, if the current remaining number of sheets required for finishing the current job being processed is x including the sheet being printed and the number of sheets required for finishing all of unprocessed print jobs registered in the queue other than the job being processed is y and if a new job involving z sheets is registered, the remaining number of print sheets Σ is calculated as $\Sigma=x+y+z$.

If the number of sheets required for finishing the current job being processed is x including the sheet being printed and the number of sheets required for finishing all of unprocessed print jobs registered in the queue other than the job being processed is y and if a print job involving z sheets, which is one of the unprocessed print job other than the job being processed is canceled, the remaining number of print sheets Σ is calculated as $\Sigma=x+y-z$.

If the number of sheets required for finishing the current job being processed is x including the sheet being printed and the number of sheets required for finishing all of unprocessed print jobs registered in the queue other than the job being processed is y, if the job being processed is canceled, the remaining number of print sheets Σ is calculated as $\Sigma=y$.

The remaining number of print sheets Σ is thus updated at S271. After finishing S271, the processing proceeds to S273 and the CPU 71 acquires temperature information indicating the temperature of the LF motor 20 and calculates the temperature difference between the current temperature Tn of the LF motor 20 indicated by the temperature information and the reference temperature Ts, $\Delta T=Ts-Tn$, similarly to S230.

After calculating the temperature difference ΔT, the processing proceeds to S275 and the CPU 71 calculates the target conveying velocity Vp with using the function $Vp=f(\Delta T, \Sigma)$ based on the calculated temperature difference ΔT and the remaining number of print sheets Σ and again sets the target conveying velocity Vp to the calculation value (S275).

Upon finishing S275, the processing proceeds to S277 and the CPU 71 determines whether or not cancel operation of the current print job set as the job being processed has been performed in the job management processing. If it is determined that cancel operation of the current print job set as the job being processed has been performed in the job management processing (YES at S277), the processing proceeds to S279 and causes the conveyance control unit 85*b* to drive the LF motor 20 for rotating the discharge roller 41 to discharge the post-printed sheet. Then, the processing proceeds to S320.

On the other hand, if it is determined that cancel operation has been not performed (NO at S277), the processing proceeds to S280. If it is determined that image print of the last line does not finish (NO at S280), the processing proceeds to S290 and the CPU 71 causes the conveyance control unit 85*b* to rotate the LF motor 20 at the velocity corresponding to the again set target conveying velocity Vp for conveying the sheet P by the one-pass width D downstream of the conveyance passage. In the first exemplary embodiment, the additional registration or cancel operation of the print job is performed and whenever the work amount required for finishing all of the print jobs registered in the queue changes, the remaining number of print sheets Σ is calculated and the target conveying velocity Vp is again set so that the temperature of the LF motor 20 does not exceed the reference temperature Ts before finishing all print jobs.

Figure 7A:
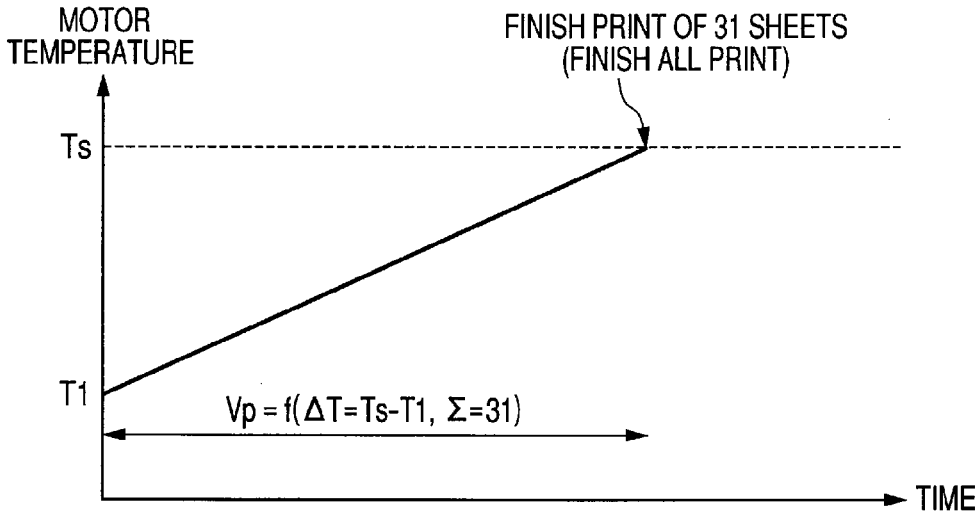
FIGS. 7A and 7B are graphs to schematically show a setting mode of the target conveying velocity and a variation in a motor temperature according to the first exemplary embodiment.
Figure 7B:
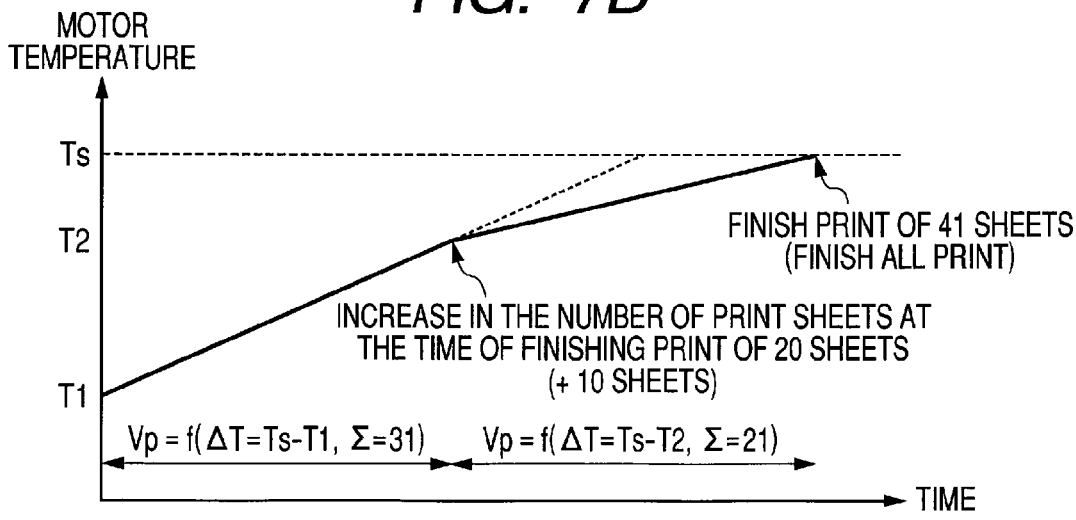

FIG. 7A is a graph to schematically show a setting mode of the target conveying velocity Vp and a temperature variation of the LF motor 20 when the additional registration or cancel operation of a print job is not performed, and FIG. 7B is a graph to schematically show a setting mode of the target conveying velocity Vp and a temperature variation of the LF motor 20 when the additional registration of a print job is performed after print control processing starts.

For example, if print job registration as a trigger of starting the print control processing is a print job for 31-sheet print data, the CPU 71 uses the temperature difference ($\Delta T=Ts-T1$) between the motor temperature T1 at the start time of the print control processing and the reference temperature Ts and the remaining number of print sheets $\Sigma=31$ at the time as input parameters, sets the target conveying velocity Vp according to the function $Vp=f(\Delta T, \Sigma)$, and conveys the sheet P to the record position by a predetermined amount at a time at the target conveying velocity Vp, as shown in FIG. 7A.

Thus, in the first exemplary embodiment, while the temperature of the LF motor 20 is prevented from reaching the reference temperature Ts before finishing the print job, the temperature of the LF motor 20 is allowed to reach the reference temperature Ts upon finishing the print job. That is, in the first exemplary embodiment, a sheet is conveyed at the maximum velocity in the range in which the temperature of the LF motor 20 does not exceed the upper limit Tp of the allowable temperature ($=Ts+\alpha$) before finishing the print job. The value $\alpha$ may be determined by a control error of the motor temperature.

On the other hand, if the print control processing starts with registration of a print job of 31 sheets as a trigger and a new print job is added during processing of that print job, the number of sheets required for processing all registered jobs is calculated as the remaining number of print sheets $\Sigma$ and the target conveying velocity Vp is again set according to the function $Vp=f(\Delta T, \Sigma)$ based on the calculated remaining number of print sheets $\Sigma$ and the difference ($\Delta T=Ts-T2$) between the motor temperature T2 of the LF motor 20 at the time and the reference temperature Ts, and the sheet P is conveyed to the record position by a predetermined amount at a time at the again set target conveying velocity Vp as shown in FIG. 7B.

For example, if a new 10-sheet print job is added at the time of processing 20-th sheets of the first print job, the remaining number of print sheets at the time becomes $\Sigma=11+10=21$ and thus the target conveying velocity Vp is again set according to the function $Vp=f(\Delta T, \Sigma)$ with $\Sigma=21$ and $\Delta T=Ts-T2$, and the sheet P is conveyed to the record position by a predetermined amount at a time at the again set target conveying velocity Vp.

Thus, in the first exemplary embodiment, if a print job is added, the temperature of the LF motor 20 is prevented from exceeding the upper limit Tp of the allowable temperature before finishing all print jobs including the added print job.

In the first exemplary embodiment, the load on the LF motor 20 is changed, so that the possibility that the LF motor 20 will exceed the upper limit Tp of the allowable temperature is low. If the LF motor 20 is driven while exceeding the upper limit Tp, a failure may occur. Thus, in the first exemplary embodiment, the CPU 71 repeats temperature monitor processing during execution of the print control processing. Accordingly, if the temperature of the LF motor 20 exceeds the upper limit Tp, execution of the print control processing is interrupted.

Figure 8:
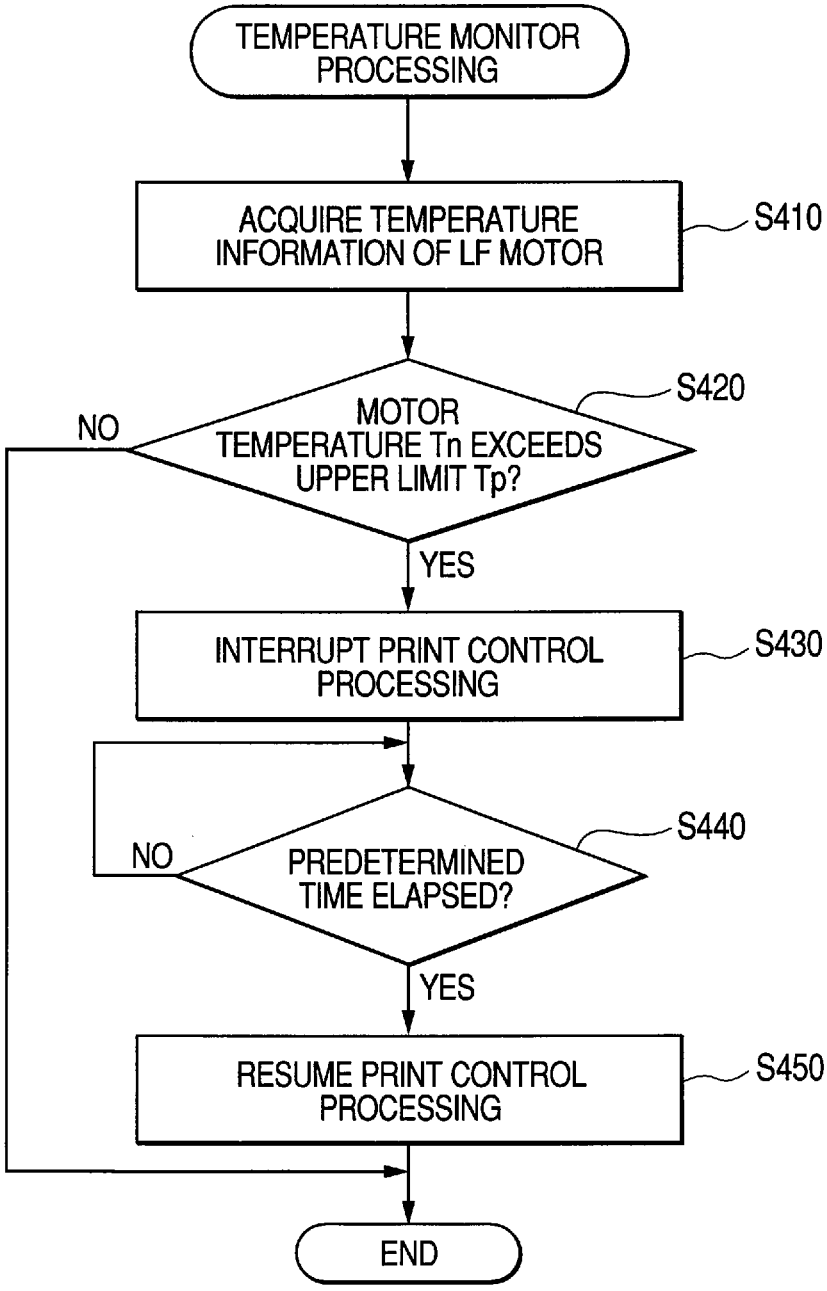
FIG. 8 is a flowchart to show temperature monitor processing according to the first exemplary embodiment.

FIG. 8 is a flowchart to show the temperature monitor processing repeated by the CPU 71 during execution of the print control processing. As shown in FIG. 8, upon starting the temperature monitor processing, first the CPU 71 acquires temperature information indicating the temperature of the LF motor 20 detected by the temperature sensor 27 from the temperature sensor 27 (S410).

Then, it is determined whether or not the temperature of the LF motor 20 exceeds the upper limit Tp based on the acquired temperature information (S420). If it is determined that the temperature exceeds the upper limit Tp (YES at S420), the processing proceeds to S430 and the print control processing being concurrently executed is interrupted temporarily. The CPU 71 waits for a predetermined time (S440) and when the predetermined time has elapsed (YES at S440), the CPU 71 resumes the interrupted print control processing (S450) and once finishes the temperature monitor processing. Then, again the CPU 71 starts the processing from S410.

On the other hand, if it is determined that the temperature does not exceed the upper limit Tp (NO at S420), the CPU 71 skips S430 to S450 and once finishes the temperature monitor processing. Then, again the CPU 71 starts the processing from S410.

Thus, in the first exemplary embodiment, if the temperature of the LF motor 20 exceeds the upper limit Tp of the allowable temperature, driving the LF motor 20 is once stopped and the CPU 71 waits for a predetermined time until the LF motor 20 is cooled for circumventing a problem of a failure, etc., occurring due to operation of the LF motor 20 at a high temperature.

In the first exemplary embodiment, to execute the print control processing, the CR motor 33 is also driven and thus if the print job amount is large, there is a possibility that the temperature of the CR motor 33 will also exceed the upper limit of the allowable temperature similar to the LF motor 20.

However, the conveying velocity of the carriage 31 cannot flexibly be changed because of the relationship between the resolution of the image to be printed on a sheet and the ink droplet ejection speed. Thus, in the first exemplary embodiment, change of the rotation speed of the CR motor 33 according to the motor temperature is not made. According to this configuration, since temperature rise of the CR motor 33 occurring in processing a print job basically is slower than that of the LF motor 20, interrupting the print control processing due to rise in the motor temperature can be suppressed more than ever before if the LF motor 20 is controlled.

Second Exemplary Embodiment

Subsequently, an ink-jet printer 1 according to a second exemplary embodiment of the invention will be described. The ink-jet printer 1 of the second exemplary embodiment differs from the ink-jet printer 1 of the first exemplary embodiment in print control processing executed by CPU 71, and other components are basically similar to those of the ink-jet printer 1 of the first exemplary embodiment. Therefore, in the following, only the print control processing executed by the CPU 71 will be described as the second exemplary embodiment.

Figure 9:
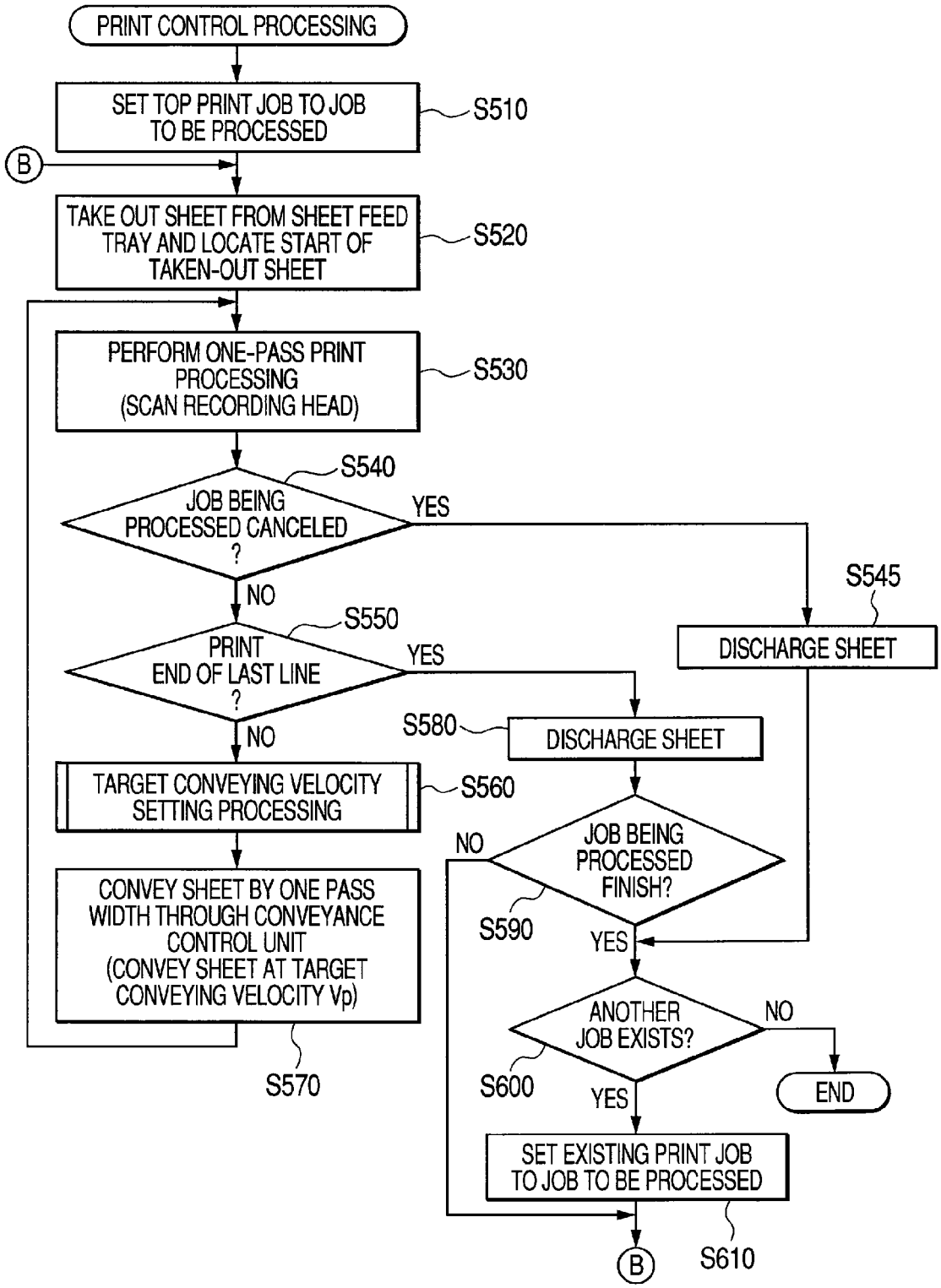
FIG. 9 is a flowchart to show print control processing of a second exemplary embodiment of the present invention.

FIG. 9 is a flowchart to show the print control processing executed by the CPU 71 of the second exemplary embodiment. Upon starting the print control processing shown in FIG. 9, first the CPU 71 sets the top print job registered in a queue to a job to be processed (S510). Then, the processing proceeds to S520. At S520, the CPU 71 starts a sheet feed control unit 85*a*, causes the sheet feed control unit 85*a* to drive a sheet feed roller 11, and causes the sheet feed roller 11 to separate one of sheets P placed on a sheet feed tray 3 and convey the leading end of the sheet P to a contact SP1 between a conveying roller 21 and a pinch roller 22. Accordingly, the sheet feed operation to the conveying roller 21 is performed.

When the sheet P is conveyed to the contact SP1, the CPU 71 starts a conveyance control unit 85*b*, causes the conveyance control unit 85*b* to drive the conveying roller 21, and causes the conveying roller 21 to take the sheet P conveyed to the contact SP1 into the downstream part of a conveyance passage and convey the sheet P until the print start point in the sheet P reaches the record position. That is, at S520, the sheet feed and beginning location operation is performed. It is assumed that that the sheet conveying velocity at the time of the sheet feed and beginning location operation is previously fixed irrespective of the temperature Tn of an LF motor 20.

Upon finishing the beginning location operation of the sheet P in such a manner, the processing proceeds to S530. At S530, print processing for one-path width is performed to form an image based on the print data corresponding to the job being processed in the area of the print sheet P at the record position. That is, at S530, the CPU 71 inputs a command to a head and motor control unit 80, starts a carriage control unit 83, and causes the carriage control unit 83 to drive a CR motor 33 for moving a carriage 31 in the main scanning direction. At the same time, the CPU 71 drives a recording head 30 through a head control unit 81 and causes the recording head 30 to execute ejection operation of ink droplets corresponding to the image to be formed while moving the carriage 31.

After the print processing for one-pass width finishes (S530), the processing proceeds to S540. At S540, the CPU 71 determines whether or not cancel operation of the job being processed is performed in job management processing. If it is determined that cancel operation is performed (YES at S540), the sheet P being printed, pinched by the conveying roller 21 or the discharge roller 41 is discharged (S545) and then the processing proceeds to S600.

On the other hand, if it is determined at S540 that cancel operation of the job being processed is not performed (NO at S540), the processing proceeds to S550. At S550, the CPU 71 determines whether or not image print of the last line of the print sheet P being printed finishes. If it is determined that image print of the last line finishes (YES at S550), the processing proceeds to S580. If it is determined that image print of the last line does not finish (NO at S550), the processing proceeds to S560.

Figure 10:
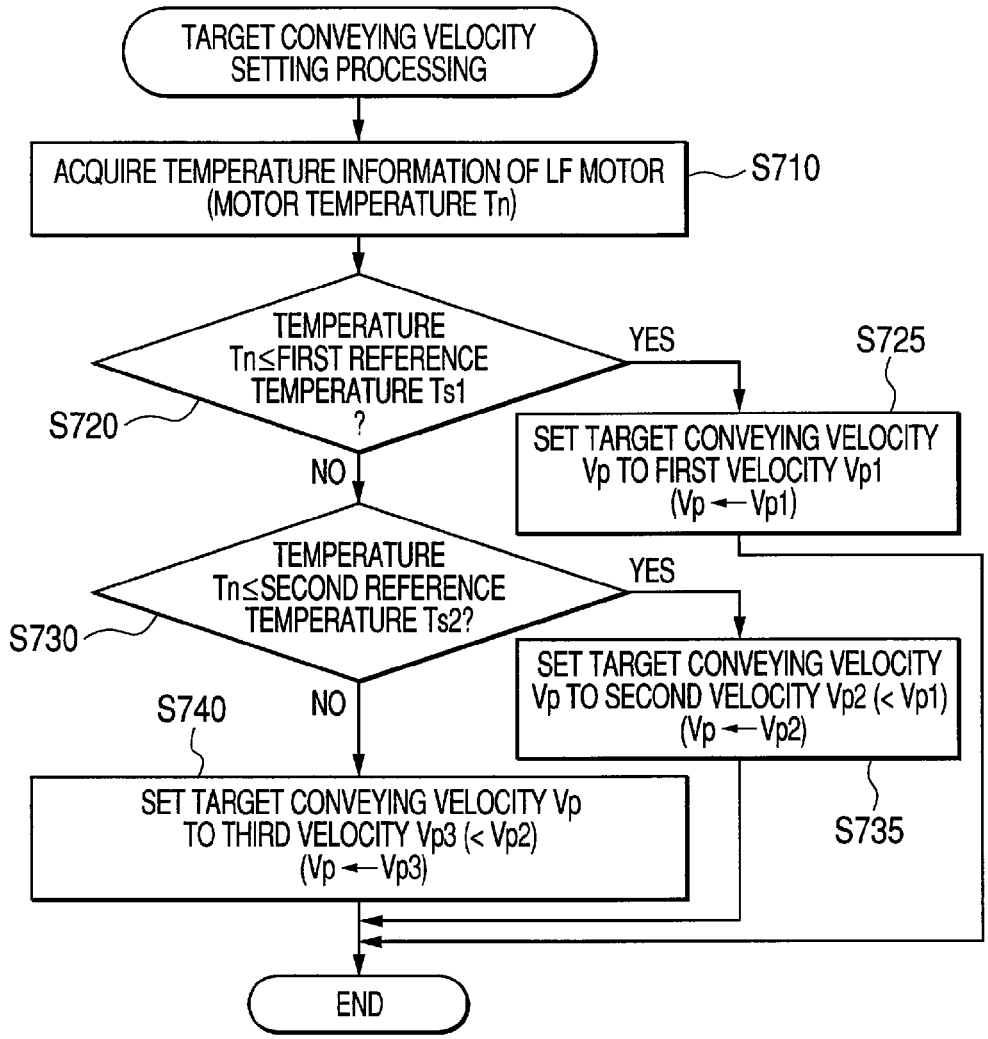
FIG. 10 is a flowchart to show target conveying velocity setting processing according to the second exemplary embodiment.

At S560, the CPU 71 executes target conveying velocity setting processing shown in FIG. 10 and sets target conveying velocity Vp. FIG. 10 is a flowchart to show the target conveying velocity setting processing executed by the CPU 71.

Upon starting the target conveying velocity setting processing at S560, first the CPU 71 acquires temperature information indicating the temperature of the LF motor 20 from a temperature sensor 27 through the head and motor control unit 80 at S710. The CPU 71 determines whether or not the current temperature Tn of the LF motor 20 indicated by the temperature information acquired from the temperature sensor 27 is equal to or less than a first reference temperature Ts1 (S720).

If it is determined that the temperature Tn of the LF motor 20 is equal to or less than the first reference temperature Ts1 (YES at S720), the CPU 71 determines that the LF motor 20 is in a temperature region in which the temperature of the LF motor 20 is the first reference temperature Ts1 or less (first temperature region) and sets the target conveying velocity Vp to a first velocity Vp1 which is predetermined for the first temperature region (S725). Then, the target conveying velocity setting processing finishes.

On the other hand, if it is determined that the temperature Tn of the LF motor 20 is higher than the first reference temperature Ts1 (NO at S720), the processing proceeds to S730. At S730, the CPU 71 determines whether or not the temperature Tn of the LF motor 20 is equal to or less than a second reference temperature Ts2. In the second exemplary embodiment, it is assumed that the designer has determined a value higher than the first reference temperature Ts1 and lower than the upper limit Tp of allowable temperature of the LF motor 20 by a predetermined amount as the second reference temperature Ts2 (Tp>Ts2>Ts1).

If it is determined that the temperature Tn of the LF motor 20 is equal to or less than the second reference temperature Ts2 (YES at S730), the CPU 71 determines that the LF motor 20 is in a temperature region in which Ts1<Tn<Ts2 is satisfied (second temperature region) and sets the target conveying velocity Vp to a second velocity Vp2 which is predetermined for the second temperature region (S735). Then, the target conveying velocity setting processing finishes. It is assumed that the second velocity Vp2 is set to a lower value than the first velocity Vp1.

If it is determined that the temperature Tn of the LF motor 20 is higher than the second reference temperature Ts2 (NO at S730), the CPU 71 determines that the LF motor 20 is in a temperature region in which the temperature of the LF motor 20 is higher than the temperature Ts2 (third temperature region) and sets the target conveying velocity Vp to a third velocity Vp3 which is predetermined for the third temperature region (S740). It is assumed that the third velocity Vp3 has determined at the design time to be a lower value than the second velocity Vp2 so as to satisfy the following condition:

That is, in the second exemplary embodiment, under the condition that the room temperature is a certain temperature (for example, 23° C.), the velocity at which the heat generation amount and the diffusion amount in the LF motor 20 match so that the temperature of the LF motor 20 does not rise if the LF motor 20 is driven and the print job is continuously processed is found experimentally and is determined to be the third velocity Vp3.

At S740, after setting the third velocity Vp3 as the target conveying velocity Vp, the target conveying velocity setting processing finishes. When the target conveying velocity setting processing at S560 finishes, the processing proceeds to S570.

At S570, the CPU 71 causes the conveyance control unit 85*b* to rotate the LF motor 20 at the velocity corresponding to the target conveying velocity Vp set at S560 for conveying the sheet P being printed by the one-pass width D downstream of the conveyance passage by the rotation operation of the conveying roller 21 or the discharge roller 41 receiving the drive force of the LF motor 20.

Upon finishing the sheet conveyance for one-pass width, the processing proceeds to S530. At S530 the CPU 71 executes print processing for one-pass width to form an image corresponding to the job being processed in the area of the sheet P delivered to the record position through the recording head 30. Then, the processing proceeds to S540. Thus, the ink-jet printer 1 forms a series of images on the sheet P by printing an image of a predetermined amount on the sheet P each time the sheet P is delivered the predetermined amount.

If it is determined CPU 71 that image print of the last line finishes (YES at S550), the processing proceeds to S580. At S580, the sheet P being printed, pinched by the conveying roller 21 or the discharge roller 41 is discharged. Then, the processing proceeds to S590.

At S590, the CPU 71 determines whether or not the job being processed finishes. If it is determined that the job being processed doe not finish (NO at S590), the processing proceeds to S520. At S520, the CPU 71 conveys a new sheet from the sheet feed tray 3 and locates the beginning of the sheet and then repeats print processing for one-pass width and sheet conveying operation alternately with the target conveying velocity setting processing between, thereby forming an image corresponding to the job being processed on the new sheet.

On the other hand, if it is determined that the job being processed finishes (YES at S590), the processing proceeds to S600. At S600, the CPU 71 determines whether or not an unprocessed print job is registered in the queue. If it is determined that an unprocessed print job is registered (YES at S600), the CPU 71 sets the top print job of unprocessed print jobs registered in the queue to a new job to be processed (S610). Then, the processing proceeds to S520, and the CPU 71 executes the subsequent steps, thereby forming an image corresponding to the new setup job to be processed on a new sheet.

If it is determined that an unprocessed print job is not registered (NO at S600), the CPU 71 finishes the print control processing and when a new print job is registered, the CPU 71 again starts the print control processing shown in FIG. 9 from S510.

Figure 11:
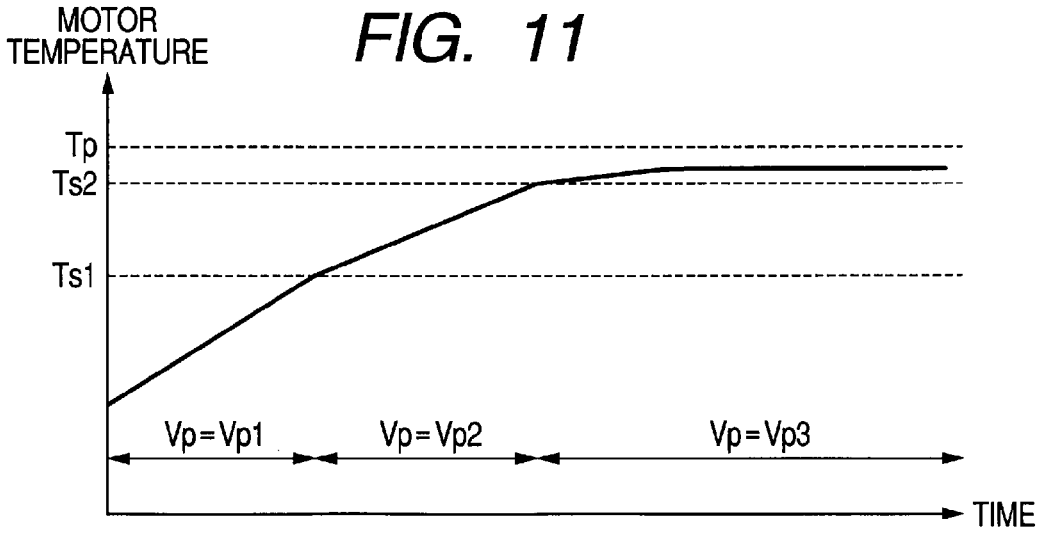
FIG. 11 is a graph to schematically show a setting mode of target conveying velocity and a variation in a motor temperature according to the second exemplary embodiment.

As described above, in the second exemplary embodiment, the print control processing is converted into a program code so that the velocities Vp1, Vp2, and Vp3 to be set as the target conveying velocity Vp are determined for the first to third temperature regions so that the rotation speed becomes lower in the higher-temperature region. In the print control processing, the target conveying velocity Vp is determined in response to the temperature region of the LF motor 20 as shown in FIG. 11 and the sheet conveying operation is performed. FIG. 11 is a graph to schematically show a setting mode of the target conveying velocity Vp and a temperature variation of the LF motor 20.

Therefore, according to the second exemplary embodiment, the appropriate target conveying velocity Vp can be set according to the motor temperature so as to prevent the print control processing from being interrupted in the temperature monitor processing as the temperature of the LF motor 20 exceeds the upper limit Tp. Accordingly, interrupting the print for the reason that the LF motor 20 becomes a high temperature can be suppressed, and the print job can be processed promptly.

Particularly, in the second exemplary embodiment, the third velocity Vp3 is set as the target conveying velocity Vp when the temperature of the LF motor 20 reaches the third temperature region of the highest temperature region. Since the third velocity Vp3 is determined such that the LF motor 20 does not become higher than the current temperature. Accordingly, interrupting the print control processing in the temperature monitor processing as the temperature of the LF motor 20 exceeds the upper limit Tp can be suppressed regardless of the job amount. Therefore, according to the second exemplary embodiment, user's dissatisfaction as print is once interrupted can be suppressed more than ever before.

While the present invention has been shown and described with reference to certain exemplary embodiments thereof, it will be understood by those skilled in the art that various changes in form and details may be made therein without departing from the spirit and scope of the invention as defined by the appended claims.

For example, the present invention can be applied not only to a printer, but also to a copier, etc. In the exemplary embodiments described above, the motor temperature is detected by the temperature sensor 27, but the temperature information may be provided by estimating the motor temperature by calculation based on the drive amount and the stop time of the motor.

The present invention provides illustrative, non-limiting embodiments as follows:

An image forming apparatus comprises an image forming mechanism, a registration unit, a control unit, a number obtaining unit and a setting unit.

The image forming mechanism includes a motor, and an image forming unit which operates by a driving force of the motor to form an image on a recording sheet. The registration unit registers a job based on an external command. The control unit processes the job registered through the registration unit by controlling the image forming mechanism to form an image corresponding to the job on a recording sheet.

The number obtaining unit obtains the number of recording sheets required for processing the job registered through the registration unit. The setting unit sets a rotation speed of the motor according to the number of recording sheets obtained by the number obtaining unit.

The control unit controls the image forming mechanism to form the image corresponding to the job registered through the registration unit on the recording sheet by rotating the motor at the rotation speed set by the setting unit.

According to the above configuration, to process the job registered through the registration unit, the rotation speed of the motor is set based on the number of recording sheets required for processing the registered job. Therefore, considering temperature rise accompanying rotation of the motor, the rotation speed of the motor can be set so that the motor temperature does not exceed the allowable temperature before finishing the job processing.

For example, if the rotation speed is set to a low value, temperature rise of the motor can be suppressed even if image forming of the same number of sheets is executed. Thus, when the number of recording sheets required for job processing is large, if the rotation speed of the motor is set to a low value, the motor temperature can be prevented from exceeding the allowable temperature before finishing the job processing.

Therefore, according to the above configuration, once stopping a motor, a failure of an apparatus, and the like because the motor temperature exceeds the allowable temperature before finishing the job processing as in a related art apparatus can be suppressed, and a preferred image forming apparatus can be provided for the user.

If the inventive concept of the present invention is applied to a copier, the control unit can register a job and can cause the image forming mechanism to form an image based on image data read through a reader as an image corresponding to the job in accordance with a copy command entered through a user interface. If the inventive concept of the present invention is applied to a printer, the control unit can register a job in accordance with a print command input from a host computer and can cause the image forming mechanism to form an image based on print data specified in accordance with the print command as an image corresponding to the job.

As a related art apparatus, a printer wherein a plurality of jobs can be registered processes the jobs in the registration order is known. Therefore, to apply the above-described art to an image forming apparatus wherein a plurality of jobs can be registered, represented by this kind of printer, specifically the image forming apparatus may be configured as follows:

The number obtaining unit may operate each time a new job is registered in the registration unit, and may obtain the remaining number of recording sheets required until finishing of processing of all jobs registered through the registration unit from the time when the number obtaining unit operates, and the setting unit may set the rotation speed of the motor to the rotation speed responsive to the number of recording sheets obtained by the number obtaining unit each time a new job is registered in the registration unit.

As another configuration of the image forming apparatus, it is also possible to skip updating the motor rotation speed if a new job is added. In this configuration, however, when a new job is added, the motor is rotated at the rotation speed not considering addition of the job and thus the motor rotation speed and the motor drive amount required for job processing do not correspond to each other and there is a possibility that the motor temperature will exceed the allowable temperature before finishing the job processing including the added job.

On the other hand, if the image forming apparatus is configured so as to set the motor rotation speed to the rotation speed responsive to the number of sheets obtained by the number obtaining unit each time when a new job is registered, the motor rotation speed can be again set considering the job amount increased by the added job, and the possibility that the motor temperature will exceed the allowable temperature before finishing the job processing including the added job can be suppressed sufficiently.

To configure the image forming apparatus so as to be able to cancel a job once registered, the setting unit may be configured so as to update the motor rotation speed if a job is canceled. If the image forming apparatus is thus configured, when the remaining job amount is decreased with a job canceled, the motor rotation speed can be increased for increasing the processing speed, and efficient job processing can be performed.

To set the motor rotation speed so that the motor temperature does not exceed the allowable temperature, the motor rotation speed may be set considering the initial temperature of the motor at the setting time. That is, the image forming apparatus may further include a temperature acquisition unit which acquires temperature information of the motor. And, the setting unit may set the rotation speed of the motor based on the temperature information acquired by the temperature acquisition unit and information of the number of recording sheets obtained by the number obtaining unit.

The temperature acquisition unit may be implemented as a temperature sensor installed in the proximity of the motor or may calculate the estimation value of the motor temperature based on the drive time and the stop time of the motor with the room temperature as the reference. If the image forming apparatus is configured so as to obtain the motor temperature by a temperature sensor, although the number of components and the manufacturing cost of the apparatus increase, the motor rotation speed can be set appropriately and the possibility that the motor temperature will exceed the allowable temperature can be still more lessened.

The setting unit may calculate temperature difference $\Delta T$ between the motor temperature indicated by the temperature information acquired by the temperature information acquisition unit and a predetermined upper limit value of motor temperature, and divide the temperature difference $\Delta T$ by the number of recording sheets N obtained by the number obtaining unit to find a value $\Delta T/N$. Then, the setting unit may set the rotation speed of the motor to a lower value as the value $\Delta T/N$ is smaller and set the rotation speed of the motor to a higher value as the value $\Delta T/N$ is larger. If the setting unit is thus configured, the motor rotation speed can be set appropriately based on the motor temperature and the remaining job amount required for the job processing.

The motor rotation speed is set based on the number of sheets, thereby suppressing the motor becoming a high temperature exceeding the allowable range. However, the image forming apparatus may be configured so as to set the motor rotation speed based on the motor temperature rather than the number of sheets.

That is, an image forming apparatus comprise an image forming mechanism, a registration unit, a control unit, a temperature acquisition unit, a setting unit. The image forming mechanism includes a motor, and an image forming unit which operates by a driving force of the motor to form an image on a recording sheet. The registration unit registers a job based on an external command. The control unit controls the image forming mechanism to form an image corresponding to the job registered through the registration unit on a recording sheet. The temperature acquisition unit acquires temperature information indicating a temperature of the motor. The setting unit sets a rotation speed of the motor according to the temperature of the motor indicated by the temperature information acquired by the temperature acquisition unit. The control unit controls the image forming mechanism to form the image corresponding to the job registered through the registration unit on the recording sheet by rotating the motor at the rotation speed set by the setting unit.

According to the above configuration, if the motor temperature rises, the motor rotation speed is suppressed, whereby job processing can be performed so that the motor temperature does not exceed the allowable temperature. Therefore, once stopping a motor, a failure of an apparatus, and the like because the motor temperature exceeds the allowable temperature before finishing the job processing as in an apparatus in related arts can be suppressed, and a preferred image forming apparatus can be provided for the user.

The image forming apparatus may be configured so as to change the motor rotation speed continuously (smoothly) for temperature change; preferably the image forming apparatus is configured so as to change the motor rotation speed discretely for temperature change. If the motor rotation speed is changed as with the latter, the rotation speed update frequency can be decreased and the apparatus processing load can be suppressed.

Specifically, a temperature is divided into a plurality of temperature range. The image forming apparatus further comprises a storage unit which stores a plurality of rotation speeds of the motor to be set by the setting unit for the plurality temperature ranges, respectively. A rotation speed for one of the plurality of temperature ranges is higher than a ration speed for another of the plurality of temperature ranges which has a higher temperature range than that of the one of the plurality of temperature ranges.

The image forming apparatus further includes a range determination unit which determines which one of the plurality of temperature ranges the temperature of the motor included in based on the temperature information acquired by the temperature acquisition unit, and the setting unit sets the rotation speed of the motor to a value corresponding to the temperature range determined by the region determination unit based on the determination result of the range determination unit.

According to the above configuration, the motor rotation speed is set stepwise for each temperature range, so that the motor rotation speed can be updated efficiently. To configure the image forming apparatus as described above, as the rotation speed of the motor to be set in the setting unit, the rotation speed in the range in which the temperature of the motor does not rise even if the control unit is caused to continuously execute the job processing may be determined for the highest temperature range of the plurality of temperature ranges. In so doing, when the motor temperature rises to a given degree, if the motor is continuously driven, the motor temperature can be prevented from rising beyond the temperature and exceeding the allowable temperature.

To deal with the case where the motor temperature exceeds the allowable temperature, the image forming apparatus may be provided with a temperature determination unit for determining whether or not the motor temperature is higher than a predetermined upper limit value based on the temperature information acquired by the temperature information acquisition unit and a prohibition unit for prohibiting job processing of the control unit until a predetermined condition is satisfied if the temperature determination unit determines that the motor temperature is higher than the upper limit value.

The image forming apparatus described above can be applied to an image forming apparatus wherein the image forming mechanism includes a roller for pinching and conveying a recording sheet, rotates the roller by the drive force of the motor, conveys the recording sheet from a tray on which the recording sheet is placed to a predetermined record position by rotation of the roller, and forms an image on the recording sheet at the record position.

If the rotation speed of the motor for driving the roller is set as described above, a situation in which it becomes impossible to convey a recording sheet because of temperature rise of the motor can be suppressed.

Particularly, in an ink-jet printer, the motor for driving the roller for conveying a recording sheet involves a larger work amount than the motor for conveying the carriage and the motor temperature easily exceeds the allowable temperature. Thus, if the inventive concept of the present invention is applied to the motor for driving the roller, an increase in the suspension time period of the apparatus at the continuous printing time in the ink-jet printer can be suppressed.

What is claimed is:

1. An image forming apparatus comprising:

an image forming mechanism including a motor, and an image forming unit which operates by a driving force of the motor to form an image on a recording sheet;

a registration unit which registers a job based on an external command;

a control unit which controls the image forming mechanism to form an image corresponding to the job registered through the registration unit on a recording sheet;

a number obtaining unit which obtains a number of recording sheets required for the job registered through the registration unit; and a setting unit which sets a rotation speed of the motor according to the number of recording sheets obtained by the number obtaining unit, and a temperature acquisition unit which acquires temperature information indicating a temperature of the motor, wherein the setting unit sets the rotation speed of the motor according to the temperature information acquired by the temperature acquisition unit and the number of recording sheets obtained by the number obtaining unit, wherein the control unit controls the image forming mechanism to form the image corresponding to the job registered through the registration unit on the recording sheet by rotating the motor at the rotation speed set by the setting unit, and wherein, when a temperature difference between the motor temperature indicated by the temperature information acquired by the temperature acquisition unit and an upper limit value of the motor temperature is represented by $\Delta T$ and the remaining number of recording sheets obtained by the number obtaining unit is represented by N, the setting unit sets the rotation speed of the motor to a lower value as a value $\Delta T/N$ is smaller, and sets the rotation speed of the motor to a higher value as the value $\Delta T/N$ is larger.

2. The image forming apparatus according to claim 1, wherein the registration unit is capable of registering a plurality of jobs, wherein the number obtaining unit obtains a remaining number of recording sheets required for all the jobs registered through the registration unit from a time when the number obtaining unit obtains the remaining number of recording sheets each time when a new job is registered through the registration unit, and wherein the setting unit sets the rotation speed of the motor according to the remaining number of recording sheets obtained by the number obtaining unit each time when a new job is registered through the registration unit.

3. The image forming apparatus according to claim 1, wherein the image forming unit includes a roller which is rotated by the drive force of the motor to pinch and convey a recording sheet from a tray, on which the recording sheet is placed, to a record position at which an image is formed on the recording sheet, and wherein the setting unit sets the rotation speed of the motor for driving the roller.

4. The image forming apparatus according to claim 1, further comprising:

a motor control unit which controls a rotation speed of the motor;

wherein, while the image forming unit forms an image corresponding to the job registered through the registration unit, if an additional job is registered through the registration unit, the motor control unit changes a rotation speed of the motor.

5. The image forming apparatus according to claim 4, wherein, if the additional job is registered through the registration unit, the motor control unit lowers the rotation speed of the motor.

6. The image forming apparatus according to claim 5, wherein the motor control unit lowers the rotation speed of the motor by an amount corresponding to the additional job.

7. The image forming apparatus according to claim 4, further comprising a canceling unit which cancels a job registered through the registration unit, wherein, while the image forming unit forms an image corresponding to a job registered through the registration unit, if the canceling unit cancels a job registered through the registration unit, the motor control unit changes the rotation speed of the motor.

8. The image forming apparatus according to claim 7, wherein, if a job registered through the registration unit is canceled through the canceling unit, the motor control unit raises the rotation speed of the motor.

9. The image forming apparatus according to claim 1, wherein the setting unit calculates the temperature difference $\Delta T$ and divides the temperature difference $\Delta T$ by the remaining number of recording sheets N to find the value $\Delta T/N$.

* * * * *